United States Patent [19]

Anderson

[11] Patent Number: 4,506,807

[45] Date of Patent: Mar. 26, 1985

[54] POWDER DISPENSING CONTAINER FOR DRIPLESS ASSEMBLY TO AND DISASSEMBLY FROM A FLAME SPRAYING TORCH

[76] Inventor: James Y. Anderson, 1838 Cliffhill Dr., Monterey Park, Calif. 91754

[21] Appl. No.: 484,449

[22] Filed: Apr. 13, 1983

[51] Int. Cl.[3] ..... B67D 5/06; B65D 47/00

[52] U.S. Cl. ..... 222/181; 222/490; 222/214; 222/325; 604/414; 215/247; 239/85

[58] Field of Search ..... 222/325, 214, 490, 562, 222/563, 181; 604/411, 414, 415, 237, 200; 215/247; 251/149.7, 149.1; 239/85, 79

[56] References Cited

U.S. PATENT DOCUMENTS

| | | | |
|---|---|---|---|
| 584,091 | 6/1897 | Leidich | 604/237 |
| 1,241,352 | 9/1917 | Doering et al. | 222/490 |
| 2,135,386 | 11/1938 | Crabbe | 215/247 |
| 2,297,994 | 10/1942 | Vellinga | 222/490 |
| 2,436,291 | 2/1948 | Daniel | 215/247 |
| 2,583,340 | 1/1952 | Olsen | 222/490 |
| 3,194,501 | 7/1965 | Cape | 239/85 |
| 3,252,628 | 5/1966 | Broderick et al. | 222/630 |
| 4,243,150 | 1/1981 | Gunne et al. | 215/247 |

*Primary Examiner*—H. Grant Skaggs
*Attorney, Agent, or Firm*—Sellers and Brace

[57] ABSTRACT

Disclosed is a powder container for a flame spraying torch having an outlet normally closed by an elastomeric plug provided with inner and outer closely spaced diaphragms. The outer diaphragm has an aperture sized for a wiping fit with a powder dispensing tube as the latter approaches and opens a normally closed slit crosswise of the inner diaphragm thereby safeguarding against the loss of powder during both insertion and withdrawal of a powder dispensing tube through the two diaphragms. The powder dispensing tube has an inlet end upstanding axially within a well sized for telescopic assembly about the dispensing end of the powder container.

4 Claims, 4 Drawing Figures

FIG. 1.
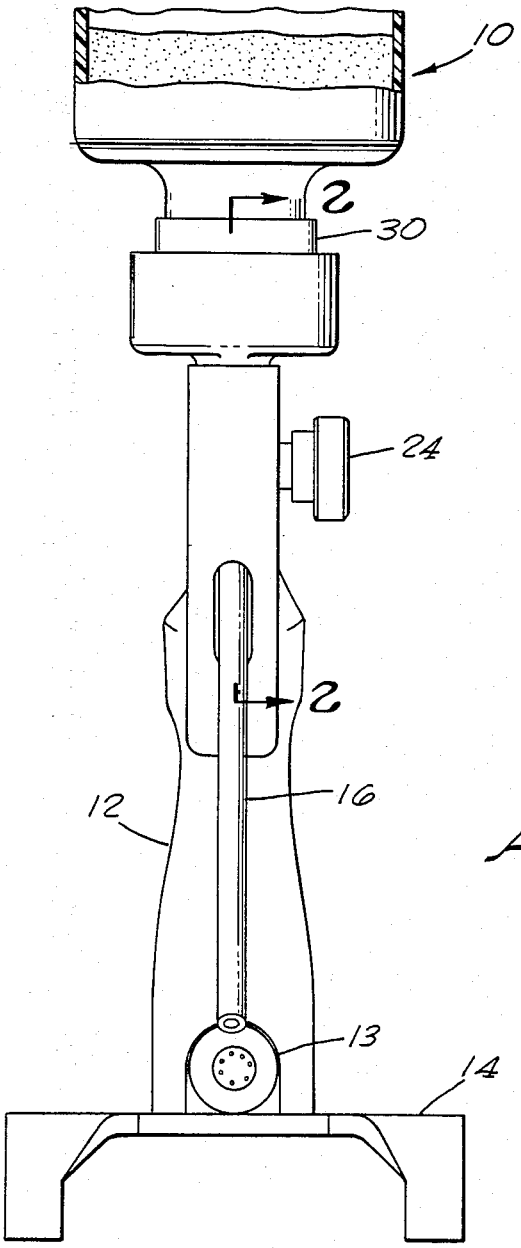
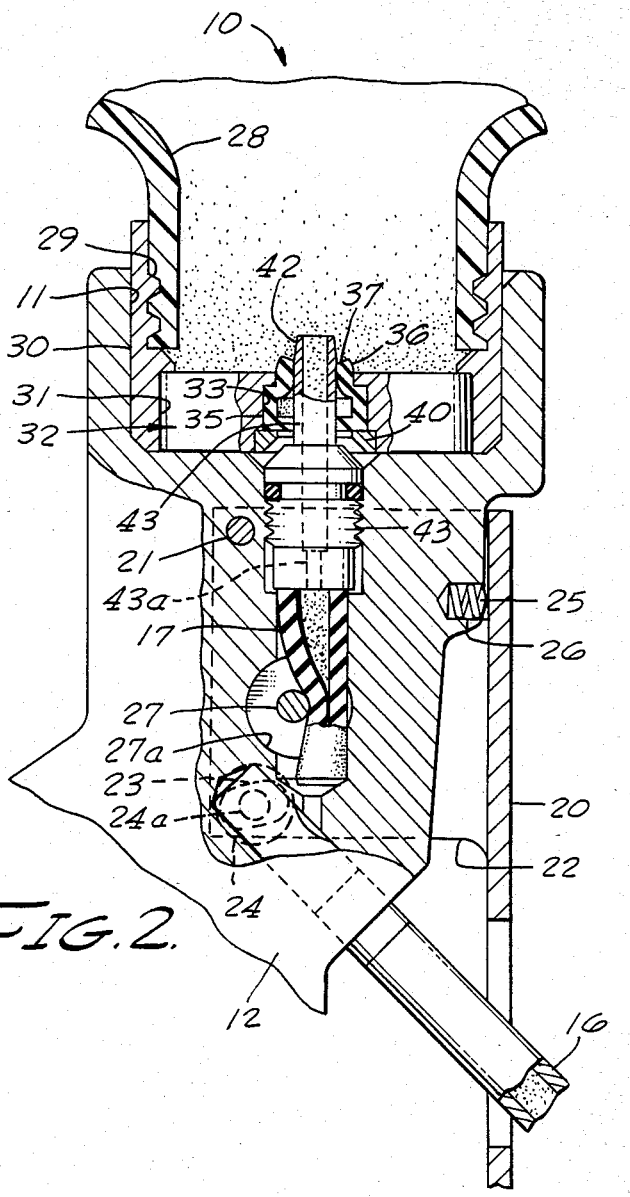
FIG. 2.
FIG. 3.
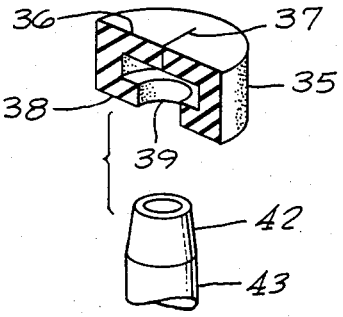
FIG. 4.
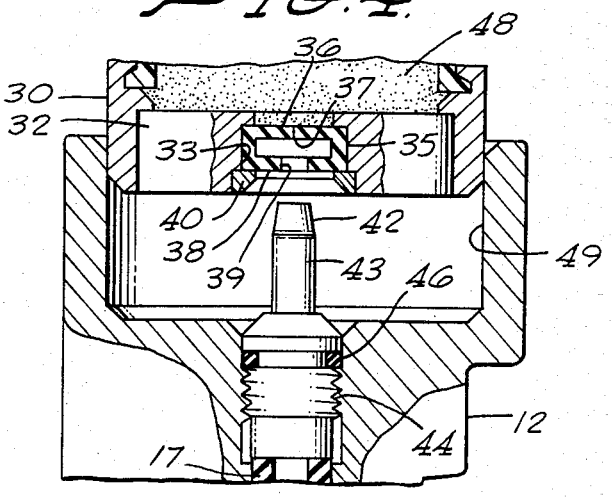

POWDER DISPENSING CONTAINER FOR DRIPLESS ASSEMBLY TO AND DISASSEMBLY FROM A FLAME SPRAYING TORCH

This invention relates to flame spraying torches and more particularly to an improved powder container having an elastomeric plug mounted thereon and uniquely designed to safeguard against the loss of powder during assembly of the container to and disassembly thereof from the inlet end of a powder feeding device of a flame spraying torch.

BACKGROUND OF THE INVENTION

Typically, flame spraying devices are equipped with some type of coupling for detachably securing a metallic powder container thereto and operable to dispense powder at a suitable rate into the torch flame for fusion to a metal object being coated therewith. Customarily, the powder is stored in shipping containers of convenient size for attachment to the torch. Frequently only a portion of the container contents is required for a particular operation. Heretofore, such containers have inadequate and unsatisfactory provision for safeguarding against the loss of the costly powder during assembly and disassembly of the container to and from the torch. Usually the powder feeds by gravity from a storage position overlying the main body of the torch.

If the torch is not fixedly mounted the operator can invert it in one hand while using the other to hold the container and to manipulate its coupling. This is awkward and cumbersome if the user must use the one hand to hold both the container and to manipulate the clamping assembly as is true of the construction proposed in the patent to Wett U.S. Pat. No. 2,671,689. Other designers propose powder containers utilizing telescopic bayonet type coupling means, such as the expedients proposed in Lamb U.S. Pat. No. 2,957,630; Broderick et al U.S. Pat. No. 3,252,628; Broderick U.S. Pat. No. 3,620,454 and Huhne et al U.S. Pat. No. 3,986,668. Each of these prior constructions involves the loss of objectionable quantities of costly hardfacing powders in those cases wherein the torch is fixedly supported relative to the work undergoing hardfacing. This is occasioned by the fact that powder flows from the container by gravity into the inlet end of the powder feed tube. It follows that there is an unavoidable loss of powder from the container feed passage which occurs while the inverted container is being assembled to and disassembled from the torch. Broderick et al U.S. Pat. No. 3,252,628 does propose an expedient for safeguarding against loss during insertion of the powder feed tube into a fully charged container but includes no provision for preventing powder loss during removal of a partially empty container.

SUMMARY OF THE INVENTION

The above mentioned and other shortcomings and disadvantages of prior containers for hardfacing powders are avoided by this invention. The charging opening of my improved powder container is provided with an elastomeric plug permitting the container to be installed in and removed from a flame spraying torch repeatedly without risk of loss of any of its contents and additionally effective to retain the container firmly in place by the gripping action of the resilient plug on the inlet end of the powder feed device. These functions and purposes are accomplished by providing the plug with a pair of closely spaced diaphragms the outer one of which is provided with an aperture having a snug fit with the powder feed tube and the inner one of which is slit for forced reception and seal with the feed tube as the latter is pressed therethrough. This assures that, during the assembly operation, the slit diaphragm remains closed until the aperture of the outer diaphragm is in sealing engagement with the feed tube. Likewise, during removal of the powder container the slit diaphragm closes first and while the feed tube is in sealing contact with the outer apertured diaphragm. The dual snug fit of the two diaphragms with the feed tube provides a strong gripping action firmly retaining the container in assembled position until deliberately withdrawn by the user. In a preferred embodiment, the rubber plug is removably installed in a cap for the container filling opening.

It is a primary object of this invention to provide an improved container for hard facing powder having unique means to facilitate the assembly and disassembly thereof to and from a flame spraying torch without loss of powder.

Another object of the invention is the provision of a novel elastomeric closure for a container of fluent material constructed and adapted for telescopic insertion to and withdrawal from a dispensing tube without loss of the fluent contents.

Another object of the invention is the provision of an elastomeric plug securable in the wall of a container having a pair of closely spaced apart diaphragms having an aperture in the outer diaphragm aligned with a normally closed slit transversely of the inner diaphragm.

These and other more specific objects will appear upon reading the following specification and claims and upon considering in connection therewith the attached drawing to which they relate.

Referring now to the drawing in which a preferred embodiment of the invention is illustrated:

FIG. 1 is a front elevational view of a typical flame spraying torch having a hardfacing powder feeding device equipped with the invention elastomeric plug;

FIG. 2 is a fragmentary cross sectional view on an enlarged scale taken along line 2—2 on FIG. 1;

FIG. 3 is an exploded view on an enlarged scale showing the elastomeric plug in cross section and axially aligned with the inlet end of the powder feeding device; and FIG. 4 is a fragmentary cross sectional view similar to FIG. 2 but showing the powder container being advanced toward coupling engagement with the inlet of the powder feed device.

Referring initially more particularly to FIG. 1, my improved powder dispensing container, designated generally 10, is shown inverted and assembled to the powder feeding well 11 integral with the handgrip 12 of a flame spraying torch 13 of a type employed in fusing a coat of hardfacing powder to a substrate to be protected.

The details of torch 13 are not a part of the present invention and are well known to persons skilled in this art. In general, the torch is of the well known type shown, for example, in the U.S. Pat. No. 3,620,454 to Wishnie. The flame outlet nozzle 13*a* of the torch is shown in elevation in FIG. 1, it being understood that the rear end of the torch is connected in known manner to a source of oxyacetelyne or other suitable fuel. The midlength portion of the nozzle is shown clamped between a supporting base 14 and the handgrip 12.

As herein shown, the hardfacing powder is dispensed from the outlet end of a powder feeding device 16 into the flame emanating from the nozzle of torch 13. This feeding device preferably includes a suitable flow control valve comprising a rubber tube 17 (FIG. 2). As is well known to persons skilled in this art, the rubber tube 17 can be collapsed by pressure applied to a manually operable control lever 20 having brackets 22 at its upper end straddling and pivoted to the sidewall of the handgrip 12 on pivot pin 21. One of the brackets 22 is provided with a slot 23 opening into a bore seating the upper end of the powder feeding device 16. This set screw clamps the powder feeding device in its assembled position with its inlet port through the sidewall thereof in registry with the outlet end of the powder feed passage at the lower end of rubber tube 17. The threaded outer end of set screw 24*a* projects through slot 23 and its threads mate with the threads axially of the clamping knob 24 for control lever 20. Knob 24 is assembled to the outer end of set screw 24*a* and, when tightened, clamps the underlying bracket 22 of lever immovably against the adjacent side of handgrip 12.

The operating handle 20 is normally held pivoted to the extended position shown in FIG. 2 by a compression spring 25 having its inner end seated in a well 26 in handgrip 12. A pin 27 having its opposite ends mounted in the brackets 22 of lever 20 extends through a large bore 27*a* crosswise of handgrip 12. When knob 24 is in its release or nonclamping position, spring 25 pivots control lever 20 counterclockwise (as shown in FIG. 2) so that pin 27 collapses the rubber tube 27 to completely block powder flow from container 10. However, if the operator depresses handle 20 to rotate it clockwise about pivot pin 21, pin 27 is shifted to the left as the rubber tube 17 expands and permits a free flow of powder. Handle 20 may be locked in this depressed condition to permit free powder flow by tightening knob 24 thereby compressing the underlying one of brackets 22 against the sidewall of the handgrip 12.

Referring now more particularly to FIGS. 2, 3 and 4, there is shown details of my improved container and the means embodied therein for assembling it to and detaching it from the powder feeding device without risking loss of powder irrespective of the position in which the torch or the container is held. As shown in the drawing by way of example, the powder container 10 has a large filling opening 28 here shown as provided on its exterior with helical threads mating with the threads 29 of a closure cap 30. The outer end of this cap is provided with a shouldered well 31 in which there is press fitted a disc 32 formed centrally thereof with a bore 33 having inner and outer shoulders. Snugly seated in this bore between the inner and outer shoulders is an elastomeric plug 35 best shown in FIG. 3. This plug has a cylindrical body provided crosswise of its opposite ends with parallel closely spaced inner and outer diaphragms 36 and 38. The inner diaphragms 36 is provided with a diametric slit 37 and the outer diaphragm 38 is provided with an aperture 39 having its axis traversed by slit 37. Plug 35 is held assembled between the inner and outer shoulders of bore 33 by a chamfered ring 40 having a press fit within the outer shouldered end of bore 33.

The axis of plug 35 is axially aligned with the tapered upper end 42 of the tubular fitting 43 forming a part of the powder feeding device and having a threaded shank 44 screwed into a threaded passage in communication with the inlet end of the rubber tube 17. Desirably, the inlet fitting 43 is sealed to the threaded bore 44 by O-ring 46 effective to prevent powder from contaminating the bore threads and its lower end is in sealing contact with the protruding upper end of rubber tube 17. Aperture 39 of the resilient plug 35 has a diameter somewhat less than the inlet end of the tubular fitting 43 so as to form a fluid tight sliding fit with the exterior thereof.

Powder container 10 may be filled with any of many different types of hardfacing powders. This charge is maintained captive in a foolproof manner by plug 35 by the inner diaphragm 36 shown in its normal closed condition in FIGS. 3 and 4. A container 10 containing either a full or a partial charge of powder 48 may be safely handled in any position without risk of leaking powder even if subjected to shock forces or rough handling.

To assemble such a container to the cylindrical well 49 containing the powder feeding fitting 43, the workman inverts the container and telescopes its closure cap 30 into the supporting well 49 at the top of the torch handgrip 12. As the container is lowered into this well the tapered upper end 42 of the powder feeding fitting 43 contacts the rim area of aperture 39. This aperture is gradually expanded as it telescopes over the tapered end 42 of fitting 43 to form a snug seal therewith. Continued insertion of the container into well 49 brings the inlet end 42 of fitting 43 into contact with the inner diaphragm causing slit 37 of this diaphragm to open and form a fluid tight fit with the exterior of fitting 43. It is therefore evident that both the inner and outer diaphragms form separate and dual fluid tight seals with the feed tube.

During this assembly operation knob 24 should be released so that spring 25 is effective to pivot control handle 26 counterclockwise so that pin 27 collapses tube 17 and blocks powder flow.

In use with the container mounted in the well at the top of the hand grip and securely held in this position by the gripping action of the two diaphragms 36, 38 on the tubular powder feeding fitting 43, the user proceeds to operate the torch and the powder feed in the usual manner. This is accomplished by depressing control lever 20 so that tube 17 expands and permits powder to flow through the calibrated orifice 43*a* into feeding device 16 and thence into the very hot flame issuing from the torch nozzle 13. Usually the operator prefers to lock the control lever in its powder feeding position and this is accomplished simply by tightening knob 24 while the control handle 20 is held depressed. At any time the operator wishes to cut off the flow of powder he releases knob 24 so that spring 25 pivots lever 20 counterclockwise about its pivot pin 21 so that pin 27 collapses tube 17.

If the user wishes to exchange one powder container for another while the first container is partially filled, he simply takes the precaution of checking to ascertain that knob 24 is released so that the control lever 20 is free, spring 25 is then effective via pin 27 to hold tube 17 collapsed. The operator can then withdraw the container axially of the powder feed tube with complete assurance that no powder can escape past the elastomeric plug 35. This is because the withdrawal operation is accompanied by the automatic closing of the inner diaphragm 36 to the position shown in FIG. 4 while the outer diaphragm 38 is still in sealing contact with the powder feed tube. Continued withdrawal movement of the container detaches the outer diaphragm 38 from the feed tube whereupon the selected substitute container of powder is telescopically assembled over the powder inlet tube in the same manner described above. It will be understood that the exterior of the container cap 30 has a close sliding fit with the sidewalls of the well at the top of the torch handgrip and this feature along with the strong frictional grip provided by the two diaphragms 36, 38 on the inlet tube 42, 43 are highly effective in holding the container firmly assembled to the handgrip without need for any auxiliary fasteners; yet the container is readily removable by deliberate withdrawal forces.

While the particular powder dispensing container for dripless connection to and disconnection from a flame spraying torch herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That improvement in a powder dispensing container adapted to be telescopically assembled over the inlet end of a tubular powder feeding device of a flame spraying torch which improvement comprises:

a powder container having an outlet closed by cap means;

said cap means having a powder dispensing passage therethrough normally closed by a cylindrical plug of elastomeric material having a chamber between the opposite ends thereof formed between inner and outer diaphragms extending crosswise of said plug, said inner diaphragm having a normally closed slit extending thereacross and said outer diaphragm having an aperture aligned with said slit and sized to have a snug wiping fit with the exterior of the inlet end of said powder feeding device whereby during telescopic assembly of said cap over the inlet of said powder feeding device said apertured diaphragm is in snug contact with said tubular inlet before the advance end thereof engages and opens said slit in said inner diaphragm; and said cap means including means press-fitted into the outer end of said powder dispensing passage in overlapping relation with the rim edge of the outer end of said plug for holding said plug assembled to said cap means.

2. That improvement defined in claim 1 characterized in that said inner and outer diaphragms are parallel to one another and closely spaced apart.

3. That improvement defined in claim 1 characterized in that said cap means is cup-shaped and provided with threads on the inner side of the sidewall thereof mateable with the threads on the exterior of the inlet end of said powder container.

4. That improvement defined in claim 3 characterized in that said powder dispensing passage extends through the bottom of said cup-shaped cap means and has a snug fit with the exterior of said elastomeric plug.

* * * * *